US006006479A

United States Patent [19]

Fayle

[11] Patent Number: 6,006,479

[45] Date of Patent: Dec. 28, 1999

[54] POLE TOP PROTECTIVE DEVICE AND METHOD

[75] Inventor: Michael J. Fayle, Elma, N.Y.

[73] Assignee: Osmose Wood Preserving, Inc., Buffalo, N.Y.

[21] Appl. No.: 08/988,343

[22] Filed: Dec. 10, 1997

[51] Int. Cl.[6] ..... E04H 12/00

[52] U.S. Cl. ..... 52/300; 52/301; 52/309.1; 52/309.3; 52/309.5; 52/309.8; 52/244; 52/736.3; 52/736.4

[58] Field of Search ..... 52/300, 309.1, 52/309.3, 309.5, 309.8, 244, 736.3, 736.4

[56] References Cited

U.S. PATENT DOCUMENTS

| | | | |
|---|---|---|---|
| 1,657,127 | 1/1928 | Kibbey | 52/300 |
| 1,996,400 | 4/1935 | Bowen | 52/300 |
| 1,996,401 | 4/1935 | Bowen | 52/300 |
| 2,139,422 | 12/1938 | Schmittutz . | |
| 2,710,996 | 6/1955 | Pittman | 52/301 |
| 3,250,050 | 5/1966 | Finger et al. | 52/301 |
| 3,319,328 | 5/1967 | Finger et al. | 29/423 |
| 3,319,332 | 5/1967 | Finger et al. | 29/450 |
| 3,352,581 | 11/1967 | Robbins et al. | 52/300 |
| 3,448,585 | 6/1969 | Vogelsang | 405/216 |
| 3,746,776 | 7/1973 | Monahan et al. . | |
| 4,161,090 | 7/1979 | Watts, Jr. . | |
| 4,245,931 | 1/1981 | Watts, Jr. . | |
| 4,312,162 | 1/1982 | Medney . | |
| 4,799,340 | 1/1989 | Lichau et al. . | |
| 5,339,594 | 8/1994 | Ventura-Berti . | |
| 5,466,094 | 11/1995 | Kirby et al. . | |
| 5,553,438 | 9/1996 | Hsu . | |

OTHER PUBLICATIONS

Osmose Material Sales web site "www.osmose.com/utilities/u_matsales.htm". "Convenient In–Service Pole–Top Protection". The Pole Topper and Pole Topper Fluid.

"Pole Topper, Pole Topper Fluid", Product Information Sheet of Osmose Wood Preserving, Inc.

*Primary Examiner*—Carl D. Friedman
*Assistant Examiner*—Jennifer I. Thissell
*Attorney, Agent, or Firm*—James C. Simmons

[57] ABSTRACT

A protective device which is quick and easy and non-messy to install for affording a moisture barrier to the upper surface of a pole. The device comprises a sheet of adhesive, moisture resistant, preferably elastomeric material for covering at least the upper surface of the pole and is adhesively attached to itself and/or the upper end portion of the pole for sealing the upper end portion against moisture.

21 Claims, 2 Drawing Sheets

POLE TOP PROTECTIVE DEVICE AND METHOD

The present invention relates generally to protective devices for the tops of poles such as utility poles, pilings, fence posts, and the like.

Deterioration of the tops of wooden poles is caused by both fungus decay and weathering action. A primary cause of this deterioration is the entry of moisture at end surfaces of the poles, due to the exposed end grains. Wherever decay causes slight depressions, usually in the faster growing and more vulnerable springwood rings, water can collect to cause wood fibers to shrink and swell, freeze and thaw. Cracks develop which eventually allow moisture and decay spores to travel beyond the original treatment and break down wood fibers. When the poles are neglected, severe decay will necessitate the costly replacement of otherwise sound poles.

Cover caps composed of polyvinylchloride (pvc) material have been installed to the tops of poles with nails in order to protect them from such deterioration. Undesirably, the cover caps are provided in different sizes for different size poles, and it is burdensome as well as dangerous to use a hammer and nails for attaching the cover caps around live electrical wires.

In another method of preventing such deterioration, a flowable asphalt-based material has been provided for many years under the trademark Pole Topper® by Osmose Wood Preserving, Inc. of Buffalo, N.Y., the assignee of the present invention. This asphalt-based material is applied to the tops of utility poles and allowed to cure. A protective fluid is uniformly poured over the pole top prior to application of the Pole Topper material.

While the Pole Topper product has worked well to prevent pole deterioration, it is awkward and time consuming to apply.

U.S. Pat. No. 4,245,931 discloses a protective covering for a post which comprises (1) a synthetic resin cap comprised of an end plate covering the end surface of the pole and a skirt which extends downwardly from the end plate and around the pole and (2) a foamed resin between the cap and the pole to prevent entrance of moisture. The fabrication of the cap on site and the foaming of the resin in place, as discussed in this reference, would make such a protective device difficult and time consuming to apply.

U.S. Pat. Nos. 3,319,328 and 3,319,332 disclose protective caps, pre-formed of one or more pieces of elastic and water impervious material, for wooden poles. A frame is provided for receiving a cap in an outwardly stretched condition so that it will fit onto the end of a pole. The frame is then positioned to apply the cap on the pole, and release of the frame therefrom is then effected. Such caps may not adequately seal to prevent the entrance of moisture to the pole tops. Furthermore, there is danger of accidentially touching live wires by use of the frame, and such danger is increased by the difficulty and awkwardness of applying the caps.

Other patents which disclose various devices for protecting utility poles and the like include U.S. Pat. Nos. 5,553,438; 5,466,094; 4,799,340; 2,139,422; 4,161,090; 3,746,776; 5,339,594; and 4,312,162. These patents also do not disclose a reliable pole end cap which is quick and easy to install.

It is accordingly an objective of the present invention to provide a suitably protective moisture barrier for the top of a pole and which may be installed easily and quickly.

It is another object of the present invention to provide such a moisture barrier wherein one size of barrier will fit various sizes of poles so that it is unnecessary for the workman to have to carry around several different sizes of barrier.

In order to provide for quick and easy application, in accordance with the present invention, a moisture barrier covering comprises an integral adhesive sheet. In order that one size of the moisture barrier may fit pole tops of various sizes as well as to provide for more effective sealing capability, the sheet is preferably composed of an elastic material.

The above and other objects, features, and advantages of the present invention will be apparent in the following detailed description of a preferred embodiment thereof when read in conjunction with the accompanying drawings wherein the same reference numerals denote the same or similar parts throughout the several views.

DETAILED DESCRIPTION OF THE PREFERRED EMBODIMENT

Figure 1:
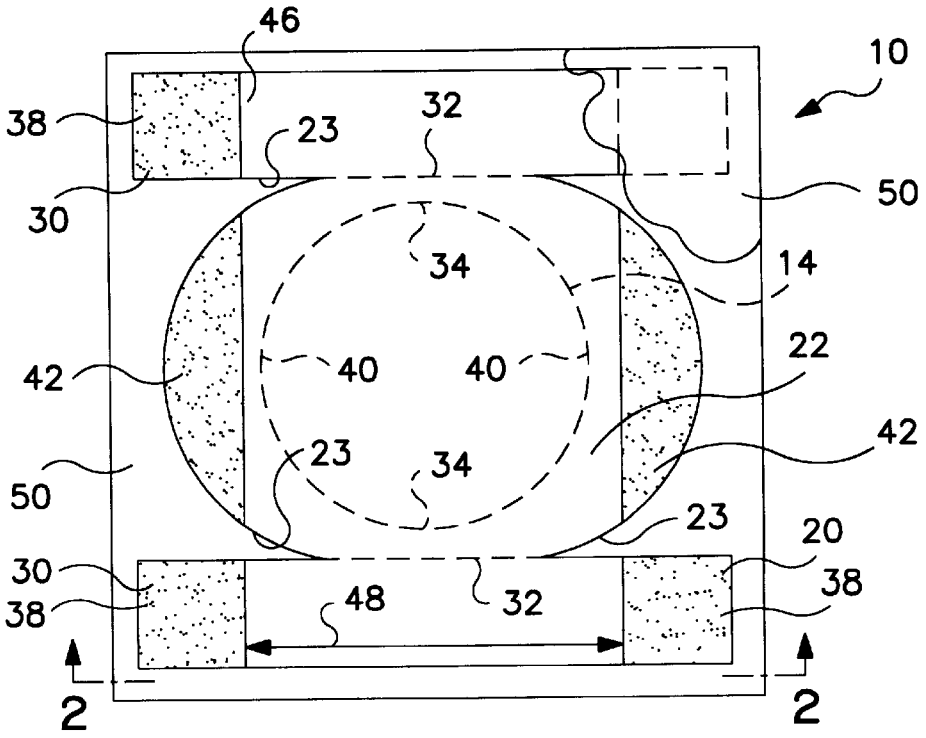
FIG. 1 is a plan view, with part of a backing sheet broken away for ease of illustration, of an end cap, prior to installation thereof, in accordance with the present invention.

Referring to FIGS. 1 to 4, there is shown generally at 10 a device which is applied to the top portion 12 of a wooden utility pole 14 for providing a moisture barrier covering of the upper end surface 16 of the utility pole. It should be understood that the device of the present invention may be used with various other poles such as pilings, fence posts, and the like and with poles composed of other types of material.

In accordance with a preferred embodiment of the present invention, the device or end cap 10 includes first and second sheets 20 and 22 respectively which are preassembled so that the end cap 10 may be brought into the field and then quickly and easily installed on a utility pole.

Sheet 20 is composed of a moisture resistant material which also desirably provides protection from the effects of ultraviolet light. Sheet 20 has a central portion 24 which overlies the upper end surface 16 and portions (described hereinafter) which fold downwardly for the purposes of securing the sheet 20 to the utility pole 14.

The use of an asphalt or tar based material for sheet 20 may result in handling difficulties in that the flowable nature of such material prior to its curing may make the application process messy. As a result, the speed and ease of application may be hindered. In order to eliminate such a messy condition so that sheet 20 may be applied easily and quickly, in accordance with the present invention, sheet 20 is composed of an integral adhesive material which is also preferably elastomeric or rubber-like so that it is stretchable during application. Both the upper and lower surfaces 26 and 28 respectively are adhesive. Unless otherwise noted, as used herein and in the claims, the term "integral" is defined as being non-flowable and non-smearable so that the material which is integral, although 10 it may be sticky due to being adhesive, remains intact during handling and does not smear or flow onto a person handling the material. Thus, an "integral" material, while it may be sticky, is distinguished from asphalt or tar based materials which would readily smear onto a person handling them. A preferred material for sheet 20, which may have a thickness of perhaps about 3/16 inch, is butyl rubber, which is polyisobutylene to which isoprene is added during manufacture. However, sheet 20 may be composed of other suitable integral materials.

Figure 4:
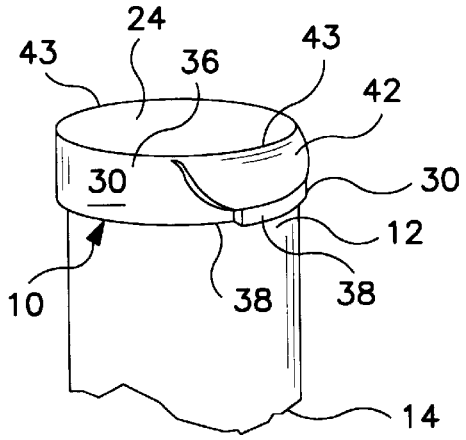
FIG. 4 is a perspective view thereof as installed on a utility pole, the second sheet not shown for ease of illustration.

A pair of generally rectangular first portions 30 extend from central portion 24 on opposite first sides or quadrants 31 respectively thereof. These portions 30 are foldable downwardly as illustrated by fold lines 32 respectively to lie along and adhere to a pair of opposite first sides or quadrants 34 of the pole 14. Each of these first portions 30 has a generally rectangular central section 36 and a pair of generally rectangular tab sections 38 extending laterally from the central section 36. These tab sections 38 are wrapped circumferentially of the pole 14, as illustrated by arrows 39 in FIG. 3, and are adhered respectively to a pair of opposite second sides or quadrants 40 of the pole 14, i.e., a tab section of one of the first portions 30 and a tab section of the other first portion 30 are adhered to one of the second quadrants 40, and the other two tab sections are adhered to the other second quadrant. The length of each tab section is desirably such that the first portions 30 together wrap all of the way around the pole 14 with one tab section overlapping the other, as illustrated in FIG. 4, in each of the second quadrants.

A pair of arcuate second portions 42 extend from central portion 24 on opposite second sides or quadrants 43 respectively thereof. These portions 42 are foldable downwardly, as illustrated by arrows 44 in FIG. 3, to overlie and adhere to the respective tab sections 38 and cover or seal the seams between the respective pairs of tab sections 38 for providing an effective moisture barrier covering.

The elastomeric nature of the sheet 20 allows it to be stretched during the process of application so that a very tight fit for an effective moisture barrier covering may be achieved. In addition, the elastomeric nature of the sheet 20 conveniently allows a single sheet size to be used for pole tops of various sizes.

For achieving effective moisture barrier and ultraviolet light protection, it should be noted that the second sheet 22 is not required.

Second sheet 22 is a relatively thin (for example, perhaps about 0.4 mm thick) generally rectangular member with cut-outs, illustrated at 23, corresponding to cut-outs in the first sheet 20 which define portions 30 and 42. Sheet 22 is attached to the adhesive or sticky upper surface 26 of sheet 20. In order to advantageously provide a non-sticky upper surface when the barrier is applied to the pole, the second sheet 22 is selected to be non-adhesive or non-sticky, i.e., it has a non-adhesive or non-sticky upper surface 46. The sheet 22 is sized and disposed to cover the central portion 24 of sheet 20 and the central sections 36 of first portions 30 thereof. The width, illustrated at 48, of sheet 22 is desirably at least as great as the diameter, typically in the neighborhood of 8 inches, of the upper end surface 16 of the utility pole 14 and preferably a greater width, as shown.

The sheet 22 is preferably a plastic material and more preferably polyethylene which affords additional protection from ultraviolet light. However, it should be understood that sheet 22 may be any other suitable material having a non-sticky upper surface.

For purposes of illustration, the end cap 10 may, for example, have a length and width of perhaps about 16 inches each, and the width 48 of sheet 22 may perhaps be about 8 inches, suitable for a typical utility pole diameter of up to about 8 inches. For another example, the end cap 10 may have a length and width of perhaps about 19 inches each, and the width 48 of sheet 22 may perhaps be about 12 inches, suitable for a typical utility pole diameter of up to about 12 inches.

To pre-assemble the end cap 10, a rectangular blank sheet (for sheet 22) is adhered to a rectangular blank sheet (for sheet 20), and the resulting structure is then stamped or otherwise suitably cut out to achieve the shape shown in FIG. 1.

Figure 2:
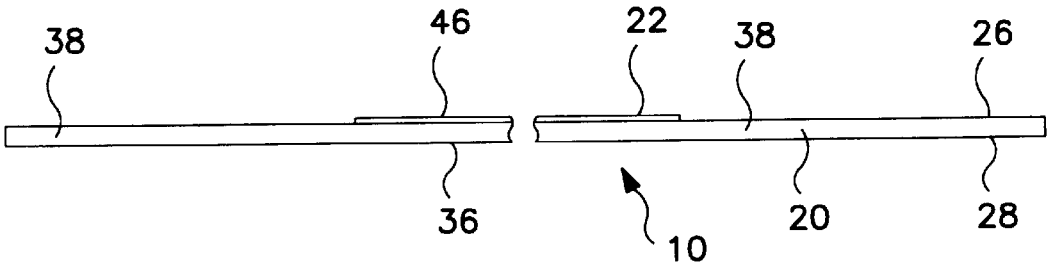
FIG. 2 is an enlarged edge view thereof taken along lines 2—2 of FIG. 1 and with backing sheets removed for ease of illustration.
Figure 3:
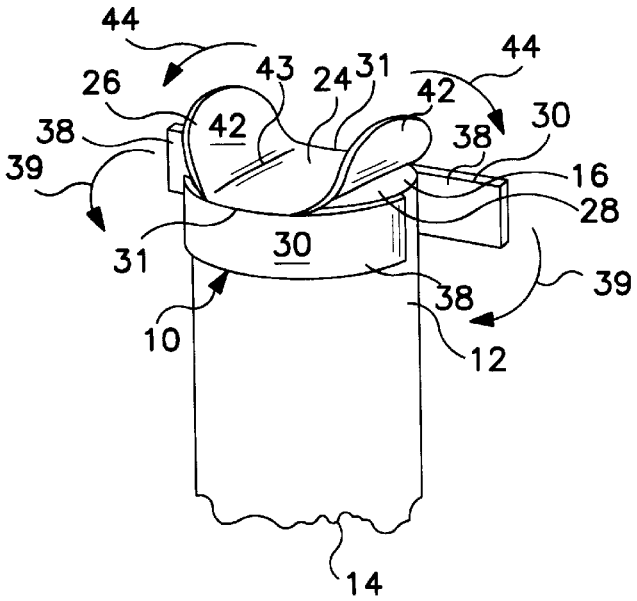
FIG. 3 is a perspective view thereof with a second sheet not shown for ease of illustration and illustrated in the process of being installed on a utility pole.

The end cap 10, whether or not it includes the second sheet 22, is packaged as a generally planar article between a pair of backing or release sheets 50 which allows ease of storage, transport, and handling prior to proceeding with installation. A protective fluid such as Pole Topper fluid supplied by Osmose Wood Preserving, Inc. of Buffalo, N.Y., may be uniformly poured over the pole top prior to installation of the end cap. In order to install the end cap 10, which has been pre-assembled, the release sheets 50 are removed and discarded, and the end cap 10, which is in the generally planar configuration shown in FIGS. 1 and 2, is then positioned so that the central portion 24 overlies and covers the upper end surface 16 of the utility pole 14. The lower surface 28 of sheet 20 is then adhesively attached to the pole surface 16 by pressing thereon. Portions 30 are then folded downwardly generally along fold lines 32 respectively and the central sections 36 thereof adhesively attached to the pole 14 by pressing thereon. Tab sections 38 are then stretched to provide a tight seal with the pole and the respective pair for each quadrant 40 brought into the overlapping relationship illustrated in FIG. 4. Each pair of tab sections are adhesively attached to each other and to the pole 14 by pressing thereon. Portions 42 are then folded downwardly and stretched and adhesively attached to the respective tab sections 38 by pressing thereon, covering and sealing seams therebetween. Thus, the pre-assembled end cap 10 may be installed on a utility pole easily and quickly and without the messiness involved in applying an asphalt or tar based covering.

Figure 5:
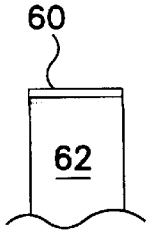
FIG. 5 is an elevation view of an pole upper end portion with an end cap, in accordance with an alternative embodiment of the present invention, installed thereto.

Referring to FIG. 5, there is shown at 60 an end cap in accordance with an alternative embodiment of the present invention. End cap 60, which is desirably more inexpensive to manufacture and easier to install, comprises a flat sheet of adhesive material, similar to the material of which sheet 20 is composed, which is applied and adhered to the top surface of a pole 62.

Figure 6:
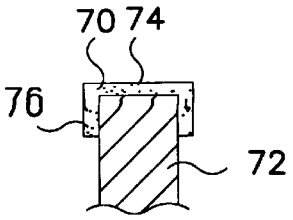
FIG. 6 is a vertical sectional view of an pole upper end portion with an end cap, in accordance with another embodiment of the present invention, installed thereto.

Referring to FIG. 6, there is shown at 70 an end cap in accordance with another embodiment of the present invention. End cap 70 comprises a flat sheet of adhesive material, similar to the material of which sheet 20 is composed, which has a central portion 74 which is applied and adhered to the top surface of a pole 72. The sheet 70 is made to have a diameter greater than that of the pole 72 so as to provide a skirt portion 76 for folding downwardly and also adhering to the side of the top of the pole 72, circumferentially thereabout, for a more secure attachment than as provided by sheet 60. If desired, the sheet 70 may be pre-formed to have the skirt portion 76.

It should be understood that, while the present invention has been described in detail herein, the invention can be embodied otherwise without departing from the principles thereof, and such other embodiments are meant to come within the scope of the present invention as defined by the appended claims.

What is claimed is:

1. In combination with a pole having an end portion and an end surface at which said end portion terminates, means for providing a moisture barrier covering of said end surface, said moisture barrier means comprising an adhesive sheet composed of a material selected to be moisture resistant, said adhesive sheet covering said end surface, wherein said sheet is an integral sheet which has a portion which is disposed to cover said end surface and has other portions which lie alongside said end portion of said pole and which are adhered one to another thereof.

2. A combination according to claim 1 wherein said sheet is adhered to said end surface and said other portions are adhered to said pole end portion.

3. A combination according to claim 2 wherein said pole is composed of wood.

4. A combination according to claim 2 further comprising a non-sticky sheet which is sized and disposed to cover and is adhered by way of said adhesive sheet to said a portion of said adhesive sheet.

5. In combination with a pole having an end portion and an end surface at which said end portion terminates, means for providing a moisture barrier covering of said end surface, said moisture barrier means comprising an adhesive sheet composed of a material selected to be moisture resistant, said adhesive sheet covering said end surface, wherein said sheet is composed of an elastomeric material.

6. A combination according to claim 4 wherein said sheet is composed of butyl rubber.

7. In combination with a pole having an end portion and an end surface at which said end portion terminates, means for providing a moisture barrier covering of said end surface, said moisture barrier means comprising an adhesive sheet composed of a material selected to be moisture resistant, said adhesive sheet having a portion covering said end surface, the combination further comprising a non-sticky sheet which is sized and disposed to cover and is adhered by way of said adhesive sheet to said a portion of said adhesive sheet.

8. A combination according to claim 7 wherein said non-sticky sheet is composed of a plastic material.

9. A combination according to claim 7 wherein said non-sticky sheet is composed of polyethylene.

10. In combination with a pole having an end portion and an end surface at which said end portion terminates, means for providing a moisture barrier covering of said end surface, said moisture barrier means comprising an adhesive sheet composed of a material selected to be moisture resistant, said adhesive sheet covering said end surface, wherein said pole is composed of wood.

11. A combination according to claim 9 wherein said pole is a utility pole.

12. A moisture barrier covering for an end surface of a pole, the covering comprising an integral adhesive elastomeric sheet of material selected to be moisture resistant and which is sized and shaped to have a portion which is disposable to cover the end surface of the pole and to have other portions which are disposable to lie alongside the pole and adhere one to another thereof to thereby seal against entrance of moisture to the end surface of the pole, and a non-sticky sheet which is sized and disposed to cover and is adhered by way of said adhesive sheet to said a portion of said adhesive sheet.

13. A moisture barrier according to claim 10 wherein said adhesive sheet is composed of butyl rubber.

14. A moisture barrier according to claim 10 wherein said non-sticky sheet is composed of a plastic material.

15. A moisture barrier according to claim 10 wherein said non-sticky sheet is composed of polyethylene.

16. A moisture barrier according to claim 11 wherein said other portions comprise a first pair of said other portions which extend from said a portion and which are folded to lie along and adhere to the pole, each of said first pair of said other portions having a central section and also having a pair of tab sections extending laterally from said central section to extend circumferentially of and adhere to the pole, and said other portions further comprise a second pair of said other portions which extend from said a portion and each of which is folded to lie along and adhere to respective ones of said tab sections.

17. A method for applying a moisture barrier to an end surface of a pole, the method comprising: (a) positioning an integral adhesive sheet of material selected to be moisture resistant to cover the pole end surface; (b) adhering the sheet to sealingly cover the pole end surface; and (c) selecting the sheet to be composed of an elastomeric material having a central portion and other portions extending from the central portion, wherein the step of positioning comprises positioning the central portion of the sheet to cover the pole end surface, and wherein the step of adhering comprises:

(a) folding the sheet so that the other portions of the integral adhesive sheet lie along the pole; and (b) adhering the other portions of the sheet one to another thereof to thereby seal against entrance of moisture to the end surface of the pole.

18. A method for applying a moisture barrier to an end surface of a pole, the method comprising: (a) positioning an integral adhesive sheet of material selected to be moisture resistant to cover the pole end surface; (b) adhering the sheet to sealingly cover the pole end surface; (c) selecting the adhesive sheet to be composed of an elastomeric material; and (d) stretching the adhesive sheet for adhering thereof.

19. A method for applying a moisture barrier to an end surface of a pole, the method comprising: (a) positioning an integral adhesive sheet of material selected to be moisture resistant to cover the pole end surface; (b) adhering a portion of the adhesive sheet to sealinaly cover the pole end surface; and (c) selecting the adhesive sheet to have pre-assembled therewith a non-sticky sheet which is sized and disposed to cover and is adhered to the adhesive sheet portion.

20. A method according to claim 17 further comprising: adhering the other portions of the integral adhesive sheet to the pole.

21. A method according to claim 20 further comprising selecting the sheet to have first and second pairs of the other portions wherein the first pair of the other portions are shaped to each have a central section and a pair of tab sections which extend from the central section to extend circumferentially of the pole, wherein the step of adhering the other portions comprises folding the first pair of other portions of the sheet and adhering the central sections thereof to the pole, adhering the tab sections to the pole, and folding and adhering to the tab sections the second pair of the other portions of the sheet.

* * * * *

UNITED STATES PATENT AND TRADEMARK OFFICE

CERTIFICATE OF CORRECTION

PATENT NO. : 6,006,479
DATED : December 28, 1999
INVENTOR(S) : Michael J. Fayle

It is certified that error appears in the above-identified patent and that said Letters Patent is hereby corrected as shown below:

Column 5, claims 3 and 4,
Line 1, change "claim 2" to -- claim 1 --.

Column 5, claim 6,
Line 1, change "claim 4" to -- claim 5 --.

Column 5, claim 11,
Line 1, change "claim 9" to -- claim 10 --.

Column 6, claims 13, 14, and 15,
Line 1, change "claim 10" to -- claim 12 --.

Column 6, claim 16,
Line 1, change "claim 11" to -- claim 12 --.

Column 6, claim 19,
Line 5, change "sealinaly" to -- sealingly --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*